US008539762B2

(12) United States Patent
Shimada et al.

(10) Patent No.: US 8,539,762 B2
(45) Date of Patent: Sep. 24, 2013

(54) HYDRAULIC CONTROL CIRCUIT FOR CONSTRUCTION MACHINE

(75) Inventors: Yoshiyuki Shimada, Kobe (JP); Hiroyasu Nishikawa, Kakogawa (JP); Masaru Mishima, Akashi (JP); Yutaka Yokoyama, Akashi (JP)

(73) Assignee: Caterpillar Japan Ltd., Tokyo (JP)

( * ) Notice: Subject to any disclaimer, the term of this patent is extended or adjusted under 35 U.S.C. 154(b) by 1062 days.

(21) Appl. No.: 12/449,824

(22) PCT Filed: Jul. 18, 2007

(86) PCT No.: PCT/JP2007/064136

§ 371 (c)(1),
(2), (4) Date: Aug. 28, 2009

(87) PCT Pub. No.: WO2008/108013

PCT Pub. Date: Sep. 12, 2008

(65) Prior Publication Data

US 2010/0089045 A1 Apr. 15, 2010

(30) Foreign Application Priority Data

Mar. 6, 2007 (JP) ..... 2007-055319

(51) Int. Cl.
*F15B 11/024* (2006.01)
*F15B 11/042* (2006.01)

(52) U.S. Cl.
USPC ..... 60/431; 60/468; 91/437

(58) Field of Classification Search
USPC ..... 60/431, 468; 91/436, 437
See application file for complete search history.

(56) References Cited

U.S. PATENT DOCUMENTS 5,442,912 A * 8/1995 Hirata et al. ..... 60/468
5,479,778 A * 1/1996 Toyooka et al. ..... 60/431

FOREIGN PATENT DOCUMENTS

| | | |
|---|---|---|
| JP | A-9-132927 | 5/1997 |
| JP | A-2000-110803 | 4/2000 |
| JP | A-2004-150305 | 5/2004 |
| JP | A-2005-256895 | 9/2005 |
| JP | A-2006-070970 | 3/2006 |
| JP | A-2006-118685 | 5/2006 |

* cited by examiner

*Primary Examiner* — F. Daniel Lopez
(74) *Attorney, Agent, or Firm* — Oliff & Berridge, PLC

(57) ABSTRACT

A hydraulic control circuit includes a hydraulic cylinder, a control valve, a recovery oil passage, a hydraulic pump, an engine rotation speed setting unit, a recovery control valve, and a controller that reduces an engine rotation speed to not more than a preset reduction control engine rotation speed when the load is lowered; and adjusts an increase or decrease in an opening amount of the recovery control valve in accordance with a level of the target rotation speed set by the engine rotation speed setting unit.

8 Claims, 5 Drawing Sheets

HYDRAULIC CONTROL CIRCUIT FOR CONSTRUCTION MACHINE

CROSS-REFERENCE TO RELATED APPLICATIONS

This application is the U.S. National Phase of PCT/JP2007/064136, filed Jul. 18, 2007, which claims priority from Japanese Patent Application No. 2007-055319, filed Mar. 6, 2007 the entire disclosure of which is incorporated herein by reference hereto.

BACKGROUND

The present disclosure relates to a hydraulic control circuit for a construction machine with a hydraulic cylinder that raises and lowers heavy loads.

There exists a construction machine such as a hydraulic shovel provided with various hydraulic actuators such as a hydraulic cylinder that raises and lowers heavy loads; a control valve that controls an oil supply and discharge to/from the hydraulic actuators based on an operation of operating units; and a hydraulic pump as a hydraulic supply source. When a hydraulic actuator is a boom cylinder for raising and lowering a boom of a hydraulic shovel, for example, the boom cylinder extends to raise the boom through an oil supply to a head-side oil chamber as a weight holding-side oil chamber and an oil discharge from a rod-side oil chamber as an anti-weight holding-side oil chamber. The boom cylinder also retracts to lower the boom through an oil supply to the rod-side oil chamber and an oil discharge from the head-side oil chamber.

In order to lower the boom, a weight that is applied to the boom (a total weight of a front working part) acts as a force by which the boom cylinder retracts, with a resultant pressure in the head-side oil chamber higher than the rod-side oil chamber. Accordingly, there is provided a recovery oil passage in which discharged oil from the head-side oil chamber is supplied as recovery oil to the rod-side oil chamber when the boom is lowered. Such recovery oil and pressure oil that is supplied from the hydraulic pump are configured to be supplied to the rod-side oil chamber while pressure is higher in the head-side oil chamber than the rod-side oil chamber.

In the arrangement in which the recovery oil passage is provided, a control valve is neutralized when the boom is lowered (see Japanese Published Unexamined Patent Application No. A-09-132927, for example), and a switching controls a supply flow rate from the hydraulic pump to the rod-side oil chamber when the boom is lowered (see Japanese Published Unexamined Patent Application No. A-2005-256895, for example). Recovery oil is supplied to the rod-side oil chamber from the head-side oil chamber while no pressure oil is supplied from the hydraulic pump in order to lower the boom. Accordingly, a discharge flow rate of the hydraulic pump can be reduced.

SUMMARY

An engine of the hydraulic shovel and various other construction machines is controlled to correspond to a target rotation speed that is set by an engine rotation speed setting unit such as an accelerator dial. The hydraulic pump is driven by the engine as a power source and controlled in such a manner that a maximum flow rate varies according to the set target rotation speed. Accordingly, a pump flow rate is controlled to increase at a higher engine rotation speed and decrease at a lower engine rotation speed. An operator can increase an engine output power by setting a higher target rotation speed in order to perform a higher speed and/or higher load operation and reduce an engine output power by setting a lower target rotation speed in order to perform a lower speed and/or lower load operation. In doing so, the operator attempts to achieve higher fuel efficiency.

However, a lowering speed of the boom does not reflect an increase or decrease in the pump flow rate that is associated with a level of the target rotation speed set by the engine rotation speed setting unit of the above-mentioned configuration. It is because the recovery oil is supplied to the rod-side oil chamber to which no pressure oil is supplied from the hydraulic pump when the boom is lowered in the air. Accordingly, a lowering speed of the boom cannot be changed even if the operator sets a target rotation speed based on a desired operation speed, type and so on by using the engine rotation speed setting unit, with resultant poor workability. The present disclosure intends to solve such a problem, and achieve other advantages.

The disclosure according to a first exemplary aspect provides a hydraulic control circuit for a construction machine that includes a hydraulic cylinder that extends and retracts to raise a load through an oil supply to a weight holding-side oil chamber and an oil discharge from an anti-weight holding-side oil chamber and lower the load through an oil supply to the anti-weight holding-side oil chamber and an oil discharge from the weight holding-side oil chamber; a control valve that controls the oil supply and discharge to/from the weight holding-side and anti-weight holding-side oil chambers of the hydraulic cylinder under an operation of a hydraulic cylinder operating unit; a recovery oil passage that supplies the oil discharge from the weight holding-side oil chamber to the anti-weight holding-side oil chamber when the load is lowered; a hydraulic pump that is driven by an engine, the hydraulic pump functioning as a hydraulic supply source for the hydraulic cylinder; an engine rotation speed setting unit that sets a target rotation speed of the engine; a recovery control valve that is disposed to the recovery oil passage; and a controller that reduces an engine rotation speed to not more than a preset reduction control engine rotation speed when the load is lowered; and adjusts an increase or decrease in an opening amount of the recovery control valve in accordance with a level of the target rotation speed set by the engine rotation speed setting unit.

The disclosure according to a second exemplary aspect provides the hydraulic control circuit for the construction machine according to the first exemplary aspect, in which the opening amount of the recovery control valve is adjusted based on a pilot pressure that is output from an electromagnetic proportional pressure control valve that operates under a control signal from the controller. The electromagnetic proportional pressure control valve is disposed to a pilot oil passage that runs to the recovery control valve from a pilot valve that outputs a pilot pressure under the operation of the hydraulic cylinder operating unit.

The first exemplary aspect contributes significantly with respect to fuel efficiency because the engine rotation speed is reduced to not more than the preset reduction control engine rotation speed when the heavy load is lowered. In addition, the amount of recovery oil, which is supplied from the weight holding-side oil chamber to the anti-weight holding-side oil chamber via the recovery control valve when the heavy load is lowered, increases or decreases in accordance with a level of the set target rotation speed set by the engine rotation speed setting unit. Accordingly, a lowering speed of the heavy load can be changed in accordance with the set target rotation speed, with resultant superior workability.

The second exemplary aspect contributes with respect to the control simplification because the opening amount of the recovery control valve increases or decreases in accordance with an operation amount of the hydraulic cylinder operating unit without an additional control in order to correspond to the operation amount of the hydraulic cylinder operating unit.

BRIEF DESCRIPTION OF THE DRAWINGS

Various embodiments of the disclosure will be described with reference to the drawings, wherein.

DETAILED DESCRIPTION OF EMBODIMENTS

Figure 1:
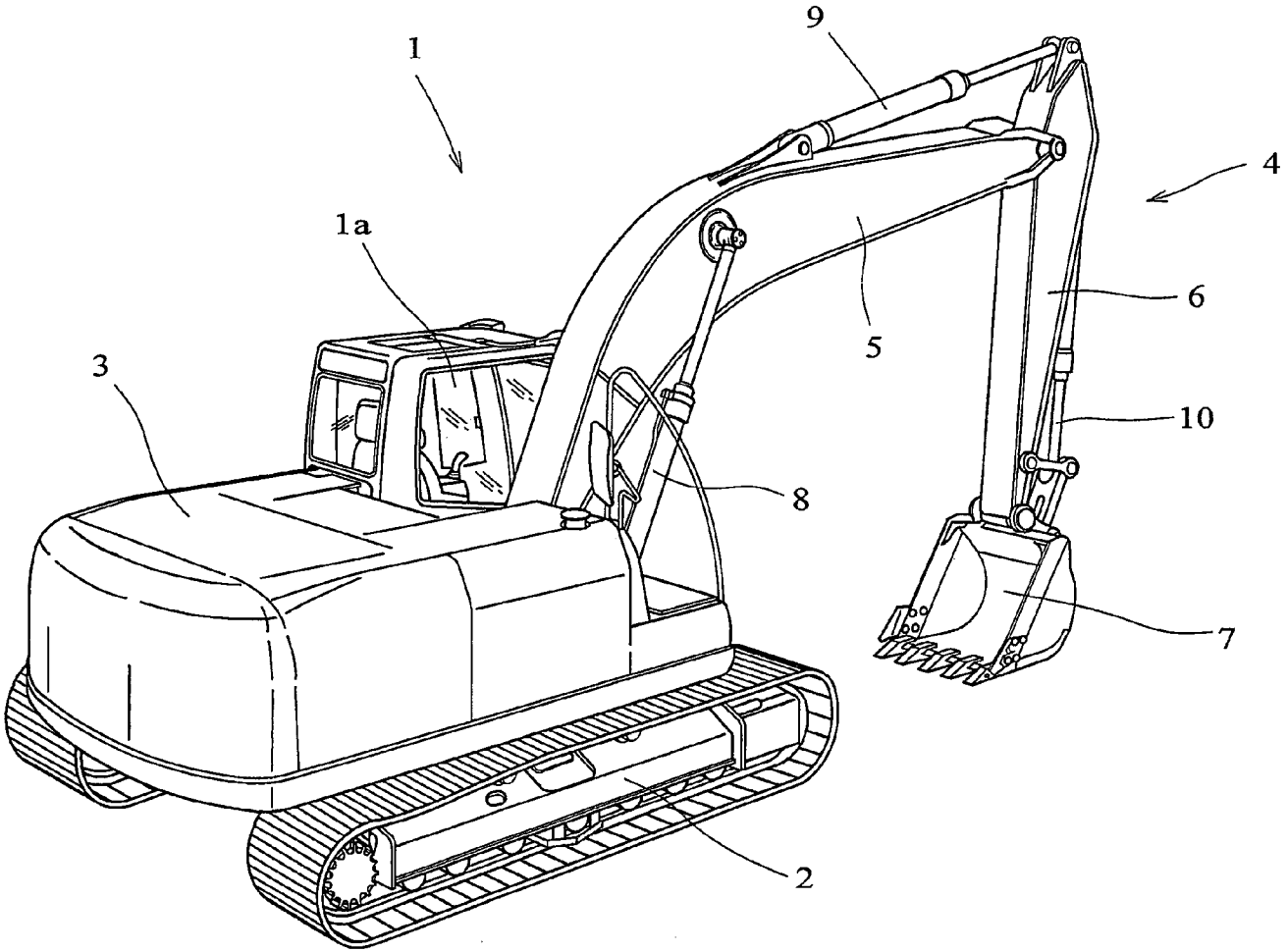
FIG. 1 is a side view of a hydraulic shovel.
Figure 2:
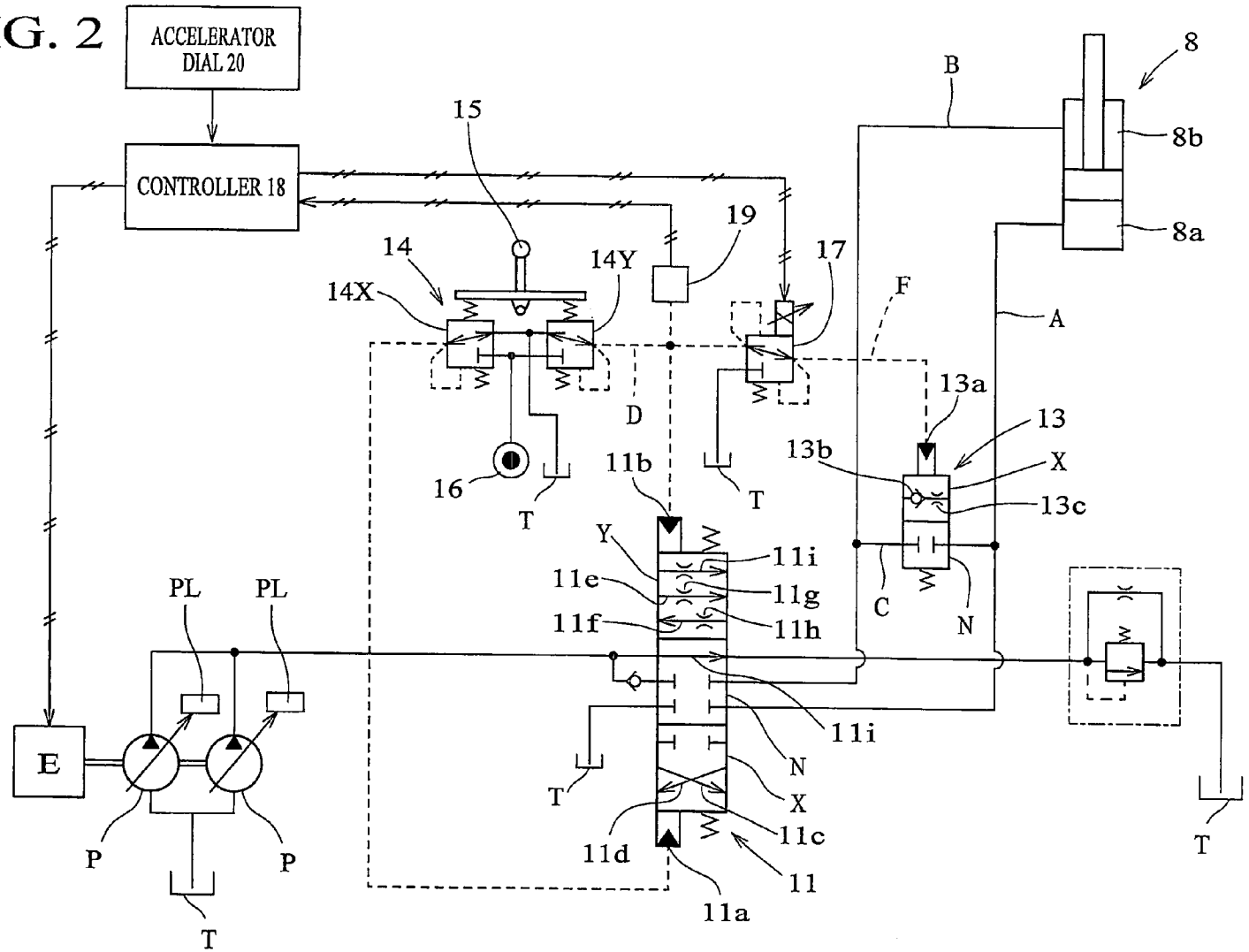
FIG. 2 is a hydraulic control circuit diagram of a boom cylinder.
Figure 3:
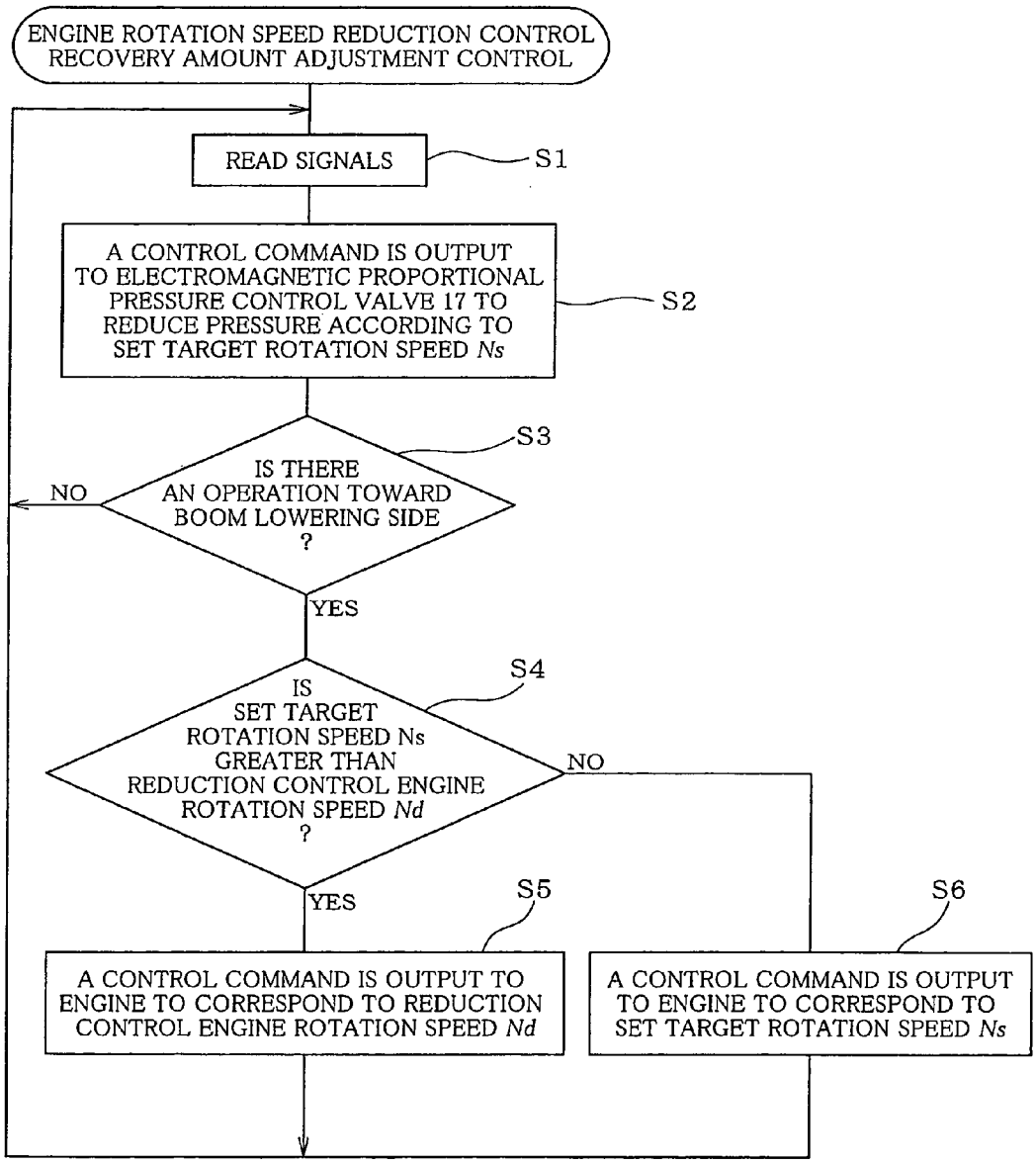
FIG. 3 is a flow chart showing a control procedure of an engine rotation speed reduction control and a recovery amount adjustment control.

A first embodiment of the present disclosure will be described with reference to FIGS. 1, 2 and 3. Reference numeral 1 denotes a hydraulic shovel in FIG. 1. The hydraulic shovel 1 includes a crawler-type lower traveling body 2; an upper rotating body 3 that is supported rotatably on the lower traveling body 2; and a front working part 4 that is fit to the upper rotating body 3. The front working part 4 includes a boom 5 that has a base end portion supported vertically movably on the upper rotating body 3; a stick 6 that is supported anteroposteriorly swingably on a leading end portion of the boom 5; and a bucket 7 that is attached to a leading end portion of the stick 6. There are also mounted various hydraulic actuators such as a boom cylinder 8; a stick cylinder 9 and a bucket cylinder 10 (see FIG. 1) as well as a rotating motor and a left and right traveling motor that are not shown, all of which are fundamental components that are conventionally structured. In addition, reference numeral 1*a* denotes a cab in which an operator drives the hydraulic shovel (see FIG. 1).

The boom cylinder 8 (corresponding to a hydraulic cylinder of the present disclosure) extends to raise the boom 5 through an oil supply to a head-side oil chamber 8*a* and an oil discharge from a rod-side oil chamber 8*b*. The boom cylinder 8 also retracts to lower the boom 5 through an oil supply to the rod-side oil chamber 8*b* and an oil discharge from the head-side oil chamber 8*a*. The head-side oil chamber 8*a* corresponds to a weight holding-side oil chamber of the present disclosure to hold a full weight of the front working part 4 as a heavy load. The rod-side oil chamber 8*b* corresponds to an anti-weight holding-side oil chamber of the present disclosure. The present disclosure is also applied to a hydraulic control circuit of the boom cylinder 8, which will be described below with reference to FIG. 2.

Reference symbol P denotes a capacity variable hydraulic pump that is driven by an engine E as a power source. Reference symbol T denotes an oil tank. Reference numeral 11 denotes a control valve that controls an oil supply and discharge to/from the boom cylinder 8. The control valve 11 includes raising-side and lowering-side pilot ports 11*a* and 11*b*. The control valve 11 is also configured to be a spool valve in which an opening amount of supply and discharge valve passages 11*c* to 11*f*, which will be described later, is adjusted based on pilot pressures that are input to the pilot ports 11*a* and 11*b*. More specifically, the control valve 11 is at a neutral position N so as not to supply or discharge oil to/from the boom cylinder 8 when no pilot pressure is input to the pilot ports 11*a* and 11*b*. Input of a pilot pressure to the raising-side pilot port 11*a* causes the control valve 11 to move to a raising-side position X to open the supply valve passage 11*c* that supplies oil that is discharged from the hydraulic pumps P to the head-side oil chamber 8*a* of the boom cylinder 8. Moving to the raising-side position X under the pilot pressure into the raising-side pilot port 11*a*, the control valve 11 also opens the discharge valve passage 11*d* that allows oil that is discharged from the rod-side oil chamber 8*b* to flow into the oil tank T. Input of a pilot pressure to the lowering-side pilot port 11*b* causes the control valve 11 to move to a lowering-side position Y to open the supply valve passage 11*e* that supplies oil that is discharged from the hydraulic pumps P to the rod-side oil chamber 8*b* through a throttle 11*g*. Moving to the lowering-side position Y under the pressure into the lowering-side pilot port 11*b*, the control valve 11 also opens the discharge valve passage 11*f* to allow discharge oil from the head-side oil chamber 8*a* to flow into the oil tank T via a throttle 11*h*.

A capacity varying device PL of the capacity variable hydraulic pumps P perform a negative flow rate control based on a flow rate through a center bypass valve passage 11*i* that is formed in the control valve 11; a constant horsepower control that controls a pump flow rate such that a horsepower is supplied constantly from the engine E; and a pump output increasing and decreasing control based on a control signal according to workload and engine rotation speed. The hydraulic pumps P are controlled such that a maximum pump flow rate is larger at a higher engine rotation speed and smaller at a lower engine rotation speed. Such flow rate controls are well known and, therefore, a detailed description thereof will be omitted.

In addition, the hydraulic pumps P functions as a hydraulic supply source for not only the boom cylinder 8 but also the various hydraulic actuators such as the not shown rotating and left and right traveling motors, the boom cylinder 8, the stick cylinder 9 and the bucket cylinder 10. Control valves are disposed to discharge lines of the hydraulic pumps P in order to control an oil supply and discharge to/from the respective hydraulic actuators, though the control valves are also not shown in FIG. 2.

Reference symbol A denotes a boom head-side oil passage that connects the control valve 11 with the head-side oil chamber 8*a* of the boom cylinder 8. Reference symbol B denotes a boom rod-side oil passage that connects the control valve 11 with the rod-side oil chamber 8*b* of the boom cylinder 8. An oil supply and discharge is carried out between the control valve 11 and the boom cylinder 8 through the boom head-side and rod-side oil passages A and B, which communicate with each other via a recovery oil passage C.

Reference numeral 13 denotes a recovery control valve that is disposed to the recovery oil passage C. The recovery control valve 13 is formed as a spool valve with a pilot port 13*a*. The control valve 13 stays in a closed position N to close the recovery oil passage C when no pilot pressure is input to the pilot port 13*a*. Input of pilot pressure to the pilot port 13*a* causes the recovery control valve 13 to switch to an open position X that opens the recovery oil passage C via a check valve 13*b* and a throttle 13*c*. When the recovery control valve 13 is at the open position X, an opening amount of the recovery control valve 13 is controlled to increase or decrease in accordance with a level of pilot pressure that is input to the pilot port 13*a*. The check valve 13*b* allows an oil flow from the boom head-side oil passage A to the boom rod-side oil passage B and prevents a reverse direction flow. Accordingly, when the recovery control valve 13 switches to the open position X so as to open the recovery oil passage C, oil that is discharged from the head-side oil chamber 8*a* can be supplied to the rod-side oil chamber 8*b* as recovery oil while a pressure in the head-side oil chamber 8*a* is higher than a pressure in the rod-side oil chamber 8*b* of the boom cylinder 8. In this state, a recovery amount from the head-side oil chamber 8*a* to the rod-side oil chamber 8*b* increases or decreases in accordance with a pressure difference between the head-side and rod-side oil chambers 8*a* and 8*b* as well as an opening amount of the recovery control valve 13.

Reference numeral 14 denotes a pilot valve that outputs a pilot pressure based on an operation of a boom operation lever 15 (corresponding to a hydraulic cylinder operating unit of the present disclosure). The pilot valve 14 includes raising-side and lowering-side pilot valves 14X and 14Y. When the boom operation lever 15 is not in operation, no pilot pressure is output from the raising-side and lowering-side pilot valves 14X and 14Y. When the boom operation lever 15 is operated toward a raising side, a pilot pressure is output from the raising-side pilot valve 14X to the raising-side pilot port 11*a* of the control valve 11. When the boom operation lever 15 is operated toward a lowering side, a pilot pressure is output from the lowering-side pilot valve 14Y to the lowering-side pilot port 11*b* of the control valve 11. In this state, a pilot pressure that is output from the pilot valve 14 is controlled to increase or decrease in accordance with an operation amount of the boom operation lever 15. Reference numeral 16 denotes a pilot hydraulic source to discharge a predetermined pressure (see FIG. 2).

Reference symbol D denotes a lowering-side pilot oil passage that runs from the lowering-side pilot valve 14Y to the lowering-side pilot port 11*b* of the control valve 11. A lowering-side branch pilot oil passage F is formed to branch from the lowering-side pilot oil passage D and lead to the pilot port 13*a* of the recovery control valve 13. The lowering-side branch pilot oil passage F corresponds to a pilot oil passage that runs from the pilot valve to the recovery control valve of the present disclosure.

Reference numeral 17 denotes an electromagnetic proportional pressure control valve that is disposed in the lowering-side branch pilot oil passage F. Based on a control signal from a controller 18, which will be described below, the electromagnetic proportional pressure control valve 17 reduces a pilot pressure that is output from the lowering-side pilot valve 14Y and outputs the pilot pressure to the pilot port 13*a* of the recovery control valve 13.

The controller 18 includes a microcomputer and the like and receives input signals from a pressure switch 19 and an accelerator dial 20, which will be described later. Based on the input signals, the controller 18 outputs control commands to the electromagnetic proportional pressure control valve 17 and the engine E in order to perform an engine rotation speed reduction control and a recovery amount adjustment control, which are will be described later.

The pressure switch 19 is connected to the lowering-side pilot oil passage D so as to determine whether the boom operation lever 15 is operated toward a lowering side. The pressure switch 19 turns on from off when a pilot pressure is output from the lowering-side pilot valve 14Y under an operation of the boom operation lever 15.

The accelerator dial 20 (corresponding to an engine rotation speed setting unit of the present disclosure) is a setting unit that is mounted in the cab 1*a* where an operator can set a target rotation speed of the engine E with each dial number of the accelerator dial 20. A target rotation speed of the engine E to be set by the accelerator dial 20 will hereinafter be referred to as a set target rotation speed Ns.

The engine rotation speed reduction control and the recovery amount adjustment control by the controller 18 will be described with reference to a flow chart in FIG. 3.

The controller 18 reads signals from the pressure switch 19 and the accelerator dial 20 (step S1).

Subsequently, the controller 18 outputs a control command to the electromagnetic proportional pressure control valve 17 to reduce an output pilot pressure from the lowering-side pilot valve 14Y in accordance with a set target rotation speed Ns that is set by the accelerator dial 20 (step S2).

In step S2, the controller 18 outputs a control command to the electromagnetic proportional pressure control valve 17 to output the pilot pressure from the lowering-side pilot valve 14Y to the pilot port 13*a* of the recovery control valve 13 without reducing the pilot pressure when the set target rotation speed Ns is at a maximum (a dial number of the accelerator dial 20 is at a maximum). When the set target rotation speed Ns decreases, the controller 18 outputs a control command to the electromagnetic proportional pressure control valve 17 in order to reduce a ratio of a secondary pressure P2 (an pilot pressure that is output from the electromagnetic proportional pressure control valve 17 and input to the pilot port 13*a* of the recovery control valve 13) with respect to a primary pressure P1 (a pilot pressure that is output from the lowering-side pilot valve 14Y and input to the electromagnetic proportional pressure control valve 17). Accordingly, P2/P1 is reduced. In this state, the recovery amount adjustment control is carried out such that an opening amount of the recovery control valve 13 is adjusted to increase or decrease in accordance with a level of the set target rotation speed Ns by the accelerator dial 20. If the boom operation lever 15 is in full operation, the recovery control valve 13 is controlled to reach a maximum opening amount when the set target rotation speed Ns is at a maximum or a smaller opening amount while the set target rotation speed Ns decreases. When the recovery control valve 13 reaches the maximum opening amount, a recovery amount is set to be a value by which the boom can be lowered fast enough even if an engine rotation speed is reduced to a preset reduction control engine rotation speed Nd by an engine rotation speed reduction control, which will be described later. In addition, if a same set target rotation speed Ns is set, the opening amount of the recovery control valve 13 is adjusted to increase or decrease in accordance with an operation amount of the boom operation lever 15 because the pilot pressure output from the lowering-side pilot valve 14Y increases or decreases in accordance with the operation amount of the boom operation lever 15.

In step S3 that follows step S2, the controller 18 determines based on an input signal from the pressure switch 19 whether there is an operation toward a boom lowering side. That is, the controller 18 determines that there is no operation toward a boom lowering side if the pressure switch 19 is off while the controller 18 determines that there is an operation toward a boom lowering side if the pressure switch 19 is on.

If it is determined "Yes" in step S3, that is, there is an operation toward a boom lowering side, the controller 18 determines based on an input signal from the accelerator dial 20 whether the set target rotation speed Ns by the accelerator dial 20 is greater than the reduction control engine rotation speed Nd (Ns>Nd?) in step S4. It returns to step S1 if it is determined "No" in step S3, that is, there is no operation toward a boom lowering side.

The reduction control engine rotation speed Nd is a preset engine rotation speed in order to reduce an engine rotation speed amid a boom lowering, thereby achieving higher fuel efficiency.

If it is determined "Yes" in step S4, that is, the target rotation speed Ns set by the accelerator dial 20 is greater than the reduction control engine rotation speed Nd (Ns>Nd), the controller 18 outputs a control command to the engine E such that the target rotation speed of the engine E corresponds to the reduction control engine rotation speed Nd (step S5).

If it is determined "No" in step S4, that is, that the set target rotation speed Ns by the accelerator dial 20 is less or equal to the reduction control engine rotation speed Nd (Ns≦Nd), the controller 18 outputs a control command to the engine E such that the target rotation speed of the engine E corresponds to the set target rotation speed Ns set by the accelerator dial 20 (step S6).

In other words, the rotation speed of the engine E is controlled down to the reduction control engine rotation speed Nd through step S5 if the set target rotation speed Ns is higher than the reduction control engine rotation speed Nd. The rotation speed of the engine E is controlled to be the set target rotation speed Ns through step S6 if the set target rotation speed Ns is not more than the reduction control engine rotation speed Nd. This achieves the engine rotation speed reduction control in which the rotation speed of the engine E is reduced to not more than the reduction control engine rotation speed Nd.

Step S1 repeats after steps S5 or S6.

According to the thus arranged first embodiment, when the boom operation lever 15 is operated toward a lowering side, a pilot pressure is output from the lowering-side pilot valve 14Y. The pilot pressure is then supplied to the lowering-side pilot port 11*b* of the control valve 11 through the lowering-side pilot oil passage D so as to cause the control valve 11 to switch to the lowering-side position Y. The pilot pressure is also supplied to the pilot port 13*a* of the recovery control valve 13 so as to cause the recovery control valve 13 to switch to the open position X, the pilot pressure having been through the electromagnetic proportional pressure control valve 17 of the lowering-side branch pilot oil passage F branching from the lowering-side pilot oil passage D. Accordingly, when the boom 5 is lowered, oil that is discharged from the head-side oil chamber 8*a* of the boom cylinder 8 is supplied as recovery oil to the rod-side oil chamber 8*b* through the recovery control valve 13 while surplus oil is discharged into the oil tank T through the control valve 11. Oil that is discharged from the hydraulic pumps P so as to be supplied through the control valve 11 flows into the recovery oil from the head-side oil chamber 8*a* so as to be supplied together to the rod-side oil chamber 8*b*. In this case, the engine E rotation speed is reduced to not more than the preset reduction control engine rotation speed Nd through the engine rotation speed reduction control and the recovery amount adjustment control by the controller 18. An opening amount of the recovery control valve 13 increases or decreases in accordance with a level of the target rotation speed Ns set by the accelerator dial 20.

Accordingly, the engine rotation speed is reduced to not more than the reduction control engine rotation speed Nd when the boom 5 is lowered. This contributes greatly to fuel efficiency. The amount of the recovery oil from the head-side oil chamber 8*a* to the rod-side oil chamber 8*b* via the recovery control valve 13 increases or decreases in accordance with the level of the set target rotation speed Ns. The lowering speed of the boom varies in accordance with a level of the set target rotation speed Ns to be set arbitrarily by the operator using the accelerator dial 20, with resultant improved workability. Further, a high-speed operation is readily available because the opening amount of the recovery control valve 13 when the set target rotation speed Ns is at maximum is set to be a sufficient recovery amount by which the boom can be lowered promptly even if the engine rotation speed is reduced to the reduction control engine rotation speed Nd.

Furthermore, the opening amount of the recovery control valve 13 is adjusted based on a pilot pressure that is output from the electromagnetic proportional pressure control valve 17 that operates based on a control signal from the controller 18. The electromagnetic proportional pressure control valve 17, which is disposed in the lowering-side branch pilot oil passage F that runs from the lowering-side pilot valve 14Y to the pilot port 13*a* of the recovery control valve 13, reduces and outputs the pilot pressure to the recovery control valve 13 in accordance with the set target rotation speed Ns, the pilot pressure having been output from the lowering-side pilot valve 14Y based on an operation of the boom operation lever 15. Accordingly, the recovery control valve 13 has an opening amount adjusted in accordance with the set target rotation speed Ns. In this case, the pilot pressure that is output from the electromagnetic proportional pressure control valve 17 to the recovery control valve 13 increases or decreases in accordance with an operation amount of the boom operation lever 15 without being controlled separately because the pilot pressure that is output from the lowering-side pilot valve 14Y serves as a primary pressure for the electromagnetic proportional pressure control valve 17. Thus, a simplified control is achieved.

Figure 4:
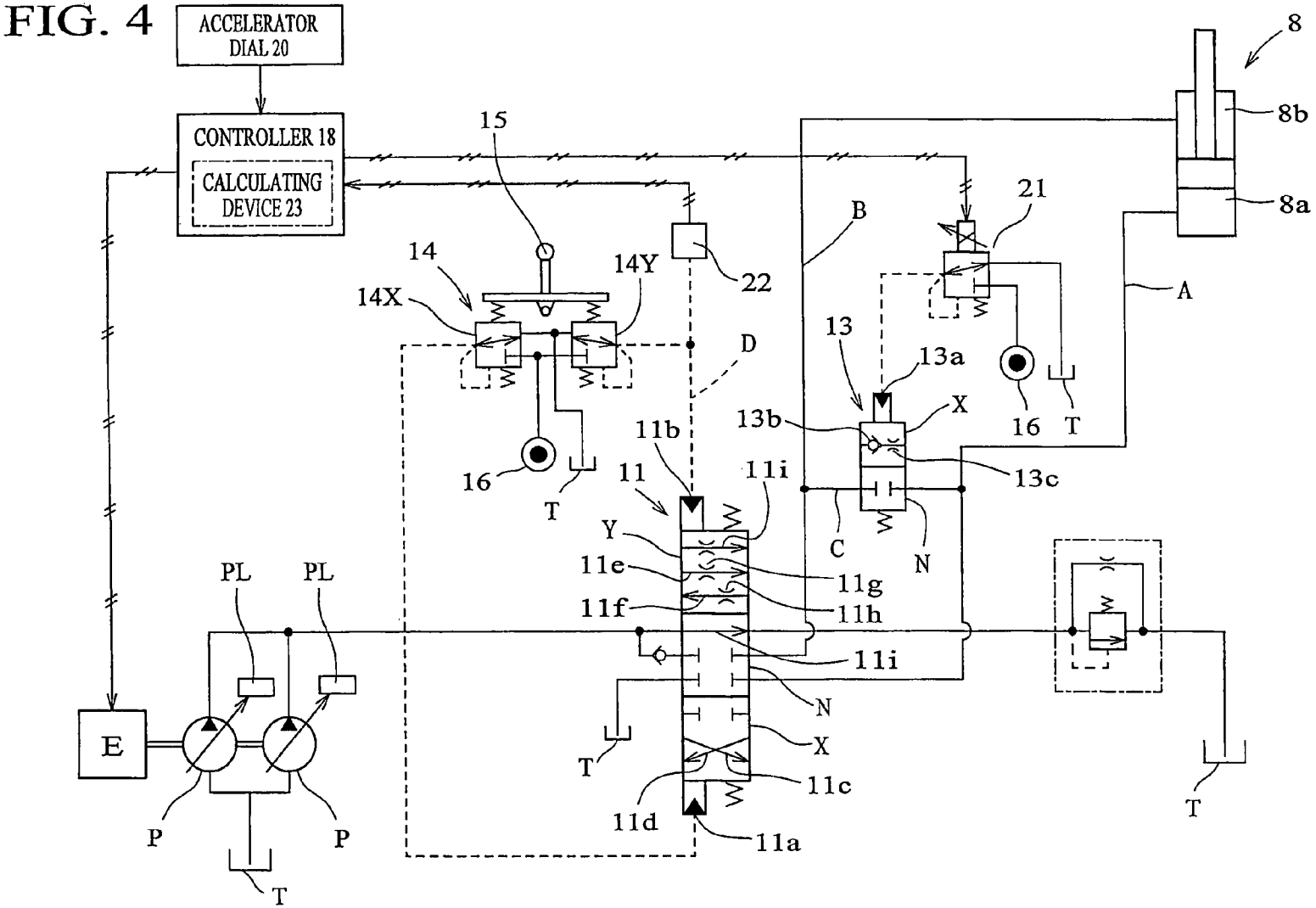
FIG. 4 is a hydraulic control circuit diagram of a boom cylinder according to a second embodiment.
Figure 5:
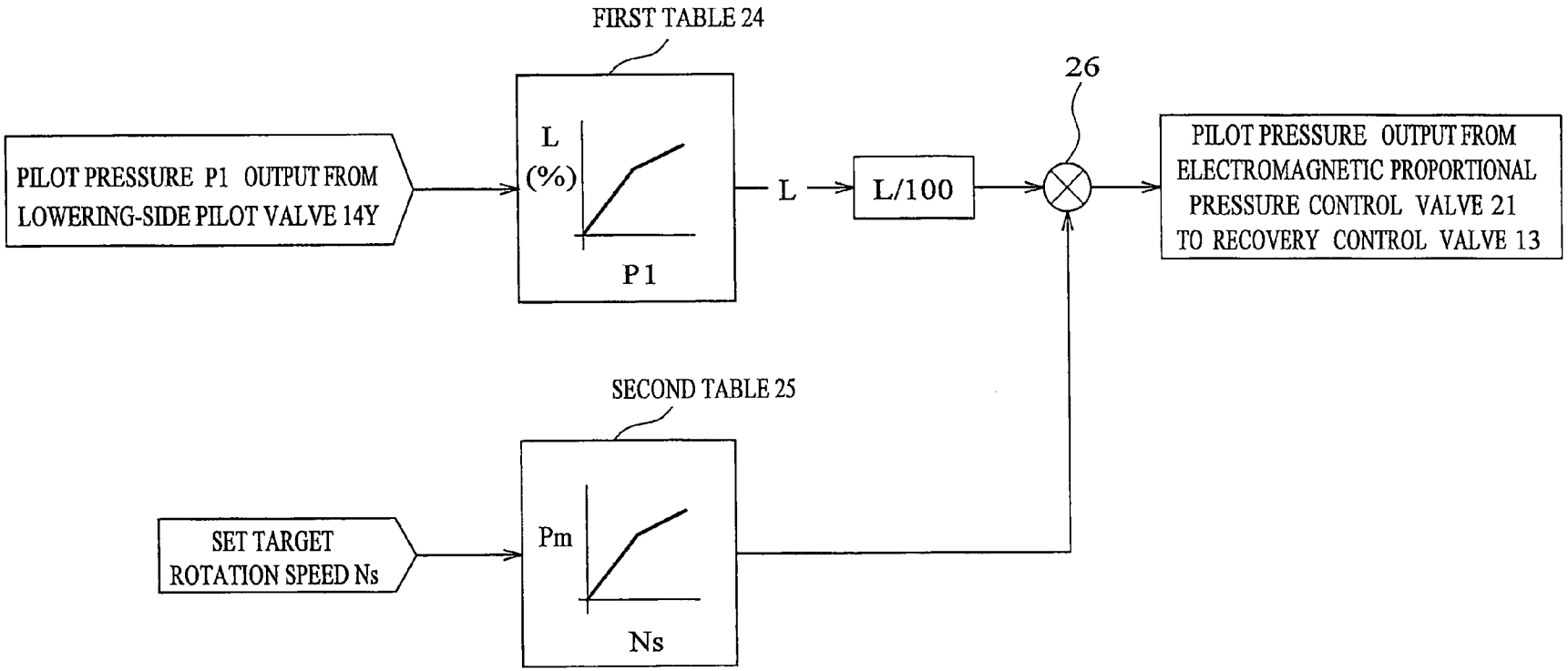
FIG. 5 is a control block diagram showing an algorithm performed by a controller according to the second embodiment.

Next, a second embodiment will be described with reference to FIGS. 4 and 5. Components in the second embodiment identical to those in the first embodiment are designated by the same reference numerals and symbols and a description thereof will be omitted. In addition, FIGS. 1 and 3 are shared with the first and second embodiments.

In the second embodiment similar to the first embodiment, an opening amount of a recovery control valve 13 disposed in a recovery oil passage C is adjusted to increase or decrease in accordance with a level of a pilot pressure that is input to a pilot port 13*a*. A pilot pressure from an electromagnetic proportional pressure control valve 21 is input to the pilot port 13*a* of the recovery control valve 13. The electromagnetic proportional pressure control valve 21 operates based on a control command from the controller 18. A primary side of the electromagnetic proportional pressure control valve 21 is connected to a pilot hydraulic source 16, according to the second embodiment. A pressure sensor 22 is connected to a lowering-side pilot oil passage D so as to detect a pilot pressure that is output from a lowering-side pilot valve 14Y.

A controller 18 performs an engine rotation speed reduction control and recovery amount adjustment control in the second embodiment as well as the first embodiment. In the recovery amount adjustment control, because the primary side of the electromagnetic proportional pressure control valve 21 is connected to the pilot hydraulic source 16 according to the second embodiment, the pilot pressure from the electromagnetic proportional pressure control valve 21 to the recovery control valve 13 should be controlled to increase or decrease in accordance with an operation amount of the boom operation lever 15. Accordingly, the controller 18 of the second embodiment includes a calculating device 23 that calculates the pilot pressure input from the electromagnetic proportional pressure control valve 21 to the recovery control valve 13 based on an operation amount of a boom operation lever 15 and a target rotation speed Ns to be set. The controller 18 outputs a control command to the electromagnetic proportional pressure control valve 21 based on a calculation result of the calculating device 23. In the second embodiment, a determination of whether there is an operation toward a boom lowering side is made based on an input signal from the pressure sensor 22 determining whether a pilot pressure that is output from the lowering-side pilot valve 14Y is not less than a preset pressure such as a minimum pressure required to move a spool of a control valve 11.

An algorithm process that is performed by the calculating device 23 will be described with reference to a control block diagram shown in FIG. 5. The calculating device 23 first inputs to a first table 24 a pilot pressure P1 that is detected by the pressure sensor 22 (a pilot pressure that is output from the lowering-side pilot valve 14Y). The calculating device 23 also inputs to a second table 25 a target rotation speed Ns that is set by an accelerator dial 20.

The first table 24 shows a relationship between the pilot pressure P1 output from the lowering-side pilot valve 14Y and an operation amount L of the boom operation lever 15. Based on the first table 24, the operation amount L of the boom operation lever 15 is obtained in a percentage (%) of its full operation.

The second table 25 shows that a pilot pressure output from the electromagnetic proportional pressure control valve 21 to the recovery control valve 13 when the boom operation lever 15 is in full operation is set preliminarily in accordance with the set target rotation speed Ns. In the second table 25, a full-operation pilot pressure Pm can be obtained that is output from the electromagnetic proportional pressure control valve 21 in accordance with the set target rotation speed Ns. The full-operation pilot pressure Pm is highest when a target rotation speed Ns is set at a maximum and decreases while the set target rotation speed Ns reduces.

In a multiplier 26, the calculating device 23 subsequently multiplies a hundredth part of the operation amount L (%) of the boom operation lever 15 obtained in the first table 24 by the full-operation pilot pressure Pm obtained in the second table 25 so as to calculate a pilot pressure that is output from the electromagnetic proportional pressure control valve 21 to the recovery control valve 13. In doing so, the pilot pressure output from the electromagnetic proportional pressure control valve 21 to the recovery control valve 13 can be controlled to increase or decrease in accordance with an operation amount of the boom operation lever 15 and a target rotation speed Ns set by the accelerator dial 20.

Accordingly, the opening amount of the recovery control valve 13 is controlled to increase or decrease in accordance with the operation amount of the boom operation lever 15 and a level of the set target rotation speed Ns even if the electromagnetic proportional pressure control valve 21 is used where the primary side is connected to the pilot hydraulic source 16. Thus, the second embodiment can achieve similar advantages of the first embodiment.

The present disclosure is not restricted to the first and second embodiments. Values detected by the pressure switch or the pressure sensor are used to determine if there is an operation toward a boom lowering side and/or calculate an operation amount of the boom operation lever according to the first and second embodiments. However, an operation detecting device may be provided so as to electrically detect a direction and/or amount of operation of the boom operation lever, for example. Accordingly, based on detection signals from the operation detecting device, the above-mentioned determination and/or calculation of the first and second embodiments may be carried out. In addition, an opening amount of the recovery control valve is adjusted based on a pilot pressure output from the electromagnetic proportional pressure control valve based on a control command from the controller according to the first and second embodiments. However, the recovery control valve in itself may be formed to be an electromagnetic proportional flow rate control valve in which an opening amount thereof is adjusted based on a control command from the controller.

Further, the negative flow rate control is employed so as to control a flow rate of the hydraulic pumps under an operation amount of operating units according to the first and second embodiments. However, the present disclosure can also be carried out by applying a positive flow rate control or a load-sensing flow rate control.

Further, the engine rotation speed reduction control and the recovery amount adjustment control of the present disclosure may be combined with a pump flow rate reduction control in which a discharge flow rate of hydraulic pumps is configured to reduce when a heavy load is lowered. Furthermore, the engine rotation speed reduction control may be deactivated amid interlocking operations in which other hydraulic actuators are operated that use hydraulic pumps as a hydraulic supply source at a time of lowering a heavy load.

The present disclosure is, of course, applicable to not only the hydraulic control circuit of the boom cylinder in the hydraulic shovel but also hydraulic control circuits for various construction machines with hydraulic cylinders for raising and lowering heavy loads.

The present disclosure is useful in a hydraulic control circuit for a construction machine with a hydraulic cylinder for raising and lowering a heavy load. A lowering speed of a heavy load can be not only changed in accordance with a set target engine rotation speed, with resultant superior workability, but also increased or decreased in accordance with an operation amount of a hydraulic cylinder operating unit, with a resultant simplified control.

The invention claimed is:

1. A hydraulic control circuit for a construction machine, the hydraulic control circuit comprising:

a hydraulic cylinder that extends and retracts to raise a load through an oil supply to a weight holding-side oil chamber and an oil discharge from an anti-weight holding-side oil chamber and lower the load through an oil supply to the anti-weight holding-side oil chamber and an oil discharge from the weight holding-side oil chamber;

a control valve that controls the oil supply and discharge to/from the weight holding-side and anti-weight holding-side oil chambers of the hydraulic cylinder under an operation of a hydraulic cylinder operating unit;

a recovery oil passage that connects the weight holding-side oil chamber and the anti-weight holding-side oil chamber;

a hydraulic pump that is driven by an engine, the hydraulic pump functioning as a hydraulic supply source for the hydraulic cylinder;

an engine rotation speed setting unit that sets a target rotation speed of the engine;

a recovery control valve that is in the recovery oil passage, the recovery control valve that supplies the oil discharge from the weight holding-side oil chamber to the anti-weight holding-side oil chamber when the load is lowered; and a controller that:

compares the target rotation speed set by the engine rotation speed setting unit and a preset reduction control engine rotation speed, if the target rotation speed set by the engine rotation speed setting unit is greater than the preset reduction control engine rotation speed, reduces an engine rotation speed to the preset reduction control engine rotation speed, if the target rotation speed set by the engine rotation speed setting unit is less than or equal to the preset reduction control engine rotation speed, sets the engine rotation speed to the target rotation speed set by the engine rotation speed setting unit, and adjusts an increase or decrease in an opening amount of the recovery control valve in accordance with a level of the target rotation speed set by the engine rotation speed setting unit.

2. The hydraulic control circuit for the construction machine according to claim 1, wherein the opening amount of the recovery control valve is adjusted based on a pilot pressure that is output from an electromagnetic proportional pressure control valve that operates under a control signal from the controller, the electromagnetic proportional pressure control valve being in a pilot oil passage that runs to the recovery control valve from a pilot valve that outputs a pilot pressure under the operation of the hydraulic cylinder operating unit.

3. The hydraulic control circuit for the construction machine according to claim 1, wherein the opening amount of the recovery control valve is adjusted based on a pilot pressure that is output from an electromagnetic proportional pressure control valve that operates under a control signal from the controller, the electromagnetic proportional pressure control valve being connected to a pilot hydraulic source.

4. The hydraulic control circuit for the construction machine according to claim 1, wherein the opening amount of the recovery control valve is adjusted also in accordance with an operation amount of the hydraulic cylinder operating unit.

5. A method of operating a hydraulic control circuit for a construction machine, the hydraulic control circuit including:

a hydraulic cylinder that extends and retracts to raise a load through an oil supply to a weight holding-side oil chamber and an oil discharge from an anti-weight holding-side oil chamber and lower the load through an oil supply to the anti-weight holding-side oil chamber and an oil discharge from the weight holding-side oil chamber;

a control valve that controls the oil supply and discharge to/from the weight holding-side and anti-weight holding-side oil chambers of the hydraulic cylinder under an operation of a hydraulic cylinder operating unit;

a recovery oil passage that connects the weight holding-side oil chamber and the anti-weight holding-side oil chamber;

a hydraulic pump that is driven by an engine, the hydraulic pump functioning as a hydraulic supply source for the hydraulic cylinder;

an engine rotation speed setting unit that sets a target rotation speed of the engine; and a recovery control valve that is in the recovery oil passage, the recovery control valve that supplies the oil discharge from the weight holding-side oil chamber to the anti-weight holding-side oil chamber when the load is lowered, the method comprising the steps of:

comparing the target rotation speed set by the engine rotation speed setting unit and a present reduction control engine rotation speed, if the target rotation speed set by the engine rotation speed setting unit is greater than the preset reduction control engine rotation speed, then reducing an engine rotation speed to the preset reduction control engine rotation speed, if the target rotation speed set by the engine rotation speed setting unit is less than or equal to the preset reduction control engine rotation speed, then setting the engine rotation speed to the target rotation speed set by the engine rotation speed setting unit, and adjusting an increase or decrease in an opening amount of the recovery control valve in accordance with a level of the target rotation speed set by the engine rotation speed setting unit.

6. The method according to claim 5, wherein the opening amount of the recovery control valve is adjusted based on a pilot pressure that is output from an electromagnetic proportional pressure control valve that operates under a control signal, the electromagnetic proportional pressure control valve being in a pilot oil passage that runs to the recovery control valve from a pilot valve that outputs a pilot pressure under the operation of the hydraulic cylinder operating unit.

7. The method according to claim 5, wherein the opening amount of the recovery control valve is adjusted based on a pilot pressure that is output from an electromagnetic proportional pressure control valve that operates under a control signal, the electromagnetic proportional pressure control valve being connected to a pilot hydraulic source.

8. The method according to claim 5, wherein the opening amount of the recovery control valve is adjusted also in accordance with an operation amount of the hydraulic cylinder operating unit.

* * * * *